US009842548B2

(12) United States Patent
Yamada

(10) Patent No.: US 9,842,548 B2
(45) Date of Patent: Dec. 12, 2017

(54) DEVICE FOR CONTROLLING DISPLAY DEVICE, METHOD OF CONTROLLING DISPLAY DEVICE, DISPLAY DEVICE, AND ELECTRONIC APPARATUS

(71) Applicant: SEIKO EPSON CORPORATION, Tokyo (JP)

(72) Inventor: Yusuke Yamada, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 13/830,593

(22) Filed: Mar. 14, 2013

(65) Prior Publication Data

US 2013/0249960 A1 Sep. 26, 2013

(30) Foreign Application Priority Data

Mar. 23, 2012 (JP) ..... 2012-067171

(51) Int. Cl.
*G09G 3/34* (2006.01)

(52) U.S. Cl.
CPC ..... *G09G 3/344* (2013.01); *G09G 2300/0842* (2013.01); *G09G 2320/041* (2013.01); *G09G 2340/0428* (2013.01); *G09G 2340/16* (2013.01); *G09G 2360/16* (2013.01)

(58) Field of Classification Search
None
See application file for complete search history.

(56) References Cited

U.S. PATENT DOCUMENTS 3,997,719 A * 12/1976 Judice ..... H04N 5/70 315/169.4
6,061,043 A * 5/2000 Bonnett et al. ..... 345/89
6,329,976 B1 * 12/2001 Johnson ..... G09G 3/3659 345/101
6,784,891 B2 * 8/2004 Inuzuka ..... G06F 3/14 345/555
2002/0012053 A1 * 1/2002 Yoshida ..... H04N 5/2176 348/243
2002/0044122 A1 4/2002 Kuwata et al.
(Continued)

FOREIGN PATENT DOCUMENTS

CN 101840666 A 9/2010
JP 2001-331144 A 11/2001
(Continued)

*Primary Examiner* — Jennifer Mehmood
*Assistant Examiner* — Parul Gupta
(74) *Attorney, Agent, or Firm* — Maschoff Brennan

(57) ABSTRACT

A control device for a display device includes an image acquisition part that designates a gray level value of each of the pixels, and acquires first image data with the number of gray levels being a-gray levels, a parameter acquisition part that acquires a parameter that decides the number of gray levels displayed by the pixel, a color reduction part that decides a number of gray levels to be displayed by the pixel according to the parameter acquired by the parameter acquisition part, and generates second image data in which the first image data acquired in the image acquisition part is color-reduced to the number of gray levels decided, and a write part that changes the gray level of the pixel to a gray level of the gray level value designated by the second image data generated in the color reduction part.

8 Claims, 5 Drawing Sheets

(56) References Cited

U.S. PATENT DOCUMENTS

| | | | | |
|---|---|---|---|---|
| 2003/0132908 | A1* | 7/2003 | Herb | G02F 1/167 345/107 |
| 2004/0095402 | A1* | 5/2004 | Nakano | 346/102 |
| 2004/0201564 | A1 | 10/2004 | Sugino et al. | |
| 2004/0263495 | A1 | 12/2004 | Sugino et al. | |
| 2005/0024310 | A1 | 2/2005 | Shiomi et al. | |
| 2005/0156838 | A1 | 7/2005 | Miyagawa et al. | |
| 2006/0284794 | A1* | 12/2006 | Johnson | G09G 3/344 345/58 |
| 2007/0057906 | A1 | 3/2007 | Johnson et al. | |
| 2007/0146561 | A1 | 6/2007 | Zhou et al. | |
| 2008/0211756 | A1 | 9/2008 | Shiomi et al. | |
| 2008/0231624 | A1* | 9/2008 | Poon | G09G 3/3611 345/212 |
| 2008/0284700 | A1* | 11/2008 | Oke et al. | 345/89 |
| 2008/0291223 | A1 | 11/2008 | Yamazaki et al. | |
| 2009/0040201 | A1 | 2/2009 | Kim et al. | |
| 2009/0058779 | A1 | 3/2009 | Yoshihara et al. | |
| 2009/0167754 | A1 | 7/2009 | Hatta | |
| 2009/0256798 | A1 | 10/2009 | Low et al. | |
| 2010/0220122 | A1 | 9/2010 | Zehner et al. | |
| 2010/0231571 | A1 | 9/2010 | Tanabe | |
| 2011/0001748 | A1 | 1/2011 | Rutman et al. | |
| 2011/0279432 | A1 | 11/2011 | Yamada | |
| 2011/0285755 | A1 | 11/2011 | Umezaki | |
| 2012/0162545 | A1 | 6/2012 | Shiomi et al. | |
| 2012/0200554 | A1 | 8/2012 | Kim et al. | |
| 2012/0262498 | A1 | 10/2012 | Kanamori et al. | |
| 2012/0262505 | A1 | 10/2012 | Muto et al. | |
| 2012/0287175 | A1 | 11/2012 | Yamada | |

FOREIGN PATENT DOCUMENTS

| | | | |
|---|---|---|---|
| JP | 2002-311900 | A | 10/2002 |
| JP | 2002-366103 | A | 12/2002 |
| JP | 2003-207762 | A | 7/2003 |
| JP | 2004-085606 | A | 3/2004 |
| JP | 2004-126320 | A | 4/2004 |
| JP | 2004-302460 | A | 10/2004 |
| JP | 2004-348151 | A | 12/2004 |
| JP | 2005-181917 | A | 7/2005 |
| JP | 2008-020858 | A | 1/2008 |
| JP | 2008-170536 | A | 7/2008 |
| JP | 2009-251615 | A | 10/2009 |
| JP | 2009-265260 | A | 11/2009 |
| JP | 2011-197513 | A | 10/2011 |
| JP | 2011-237709 | A | 11/2011 |
| JP | 2012-220826 | A | 11/2012 |
| JP | 2012-225983 | A | 11/2012 |
| JP | 2012-237958 | A | 12/2012 |
| WO | 2007/116438 | A1 | 10/2007 |

* cited by examiner

| | | GRADATION VALUE AFTER CHANGE | | | |
|---|---|---|---|---|---|
| | | 3 | 2 | 1 | 0 |
| GRADATION VALUE BEFORE CHANGE | 3 | 0 | 2 | 4 | 6 |
| | 2 | 2 | 0 | 2 | 4 |
| | 1 | 4 | 2 | 0 | 2 |
| | 0 | 6 | 4 | 2 | 0 |

| | | | |
|---|---|---|---|
| 0 | 136 | 34 | 170 |
| 204 | 68 | 238 | 102 |
| 51 | 187 | 17 | 153 |
| 255 | 119 | 221 | 85 |

DEVICE FOR CONTROLLING DISPLAY DEVICE, METHOD OF CONTROLLING DISPLAY DEVICE, DISPLAY DEVICE, AND ELECTRONIC APPARATUS

BACKGROUND

1. Technical Field

The present invention relates to devices for controlling a display device, methods for controlling a display device, display devices, and electronic apparatuses.

2. Related Art

An electro-optic device described in JP-A-2004-085606 uses colored electrophoretic particles. When an electric field is applied to the electrophoretic particles in the dispersion medium, the colored electrophoretic particles are moved thereby displaying an image. In an electro-optic device that uses dispersion medium and electrophoretic particles, the viscosity of the dispersion medium changes depending on the temperature. Therefore, such an electro-optic device has a characteristic that desired gray levels might not be obtained depending on the temperature even when the same electric filed is applied to act on the electrophoretic particles. Therefore, even when displaying the same gray level, the electro-optic device may change the electric field to be applied depending on the temperature in order to control the amount of the electrophoretic particles to be moved, so that the desired gray level can be displayed even when the temperature changes.

Though the electro-optic device described in JP-A-2004-085606 controls the drive voltage depending on the temperature to control the gray level, electrophoretic particles may move greatly with even a small change in the drive voltage when the temperature is high and thus the viscosity of the dispersion medium is low. Accordingly, in order to control the gray level in a high temperature state, a circuit capable of continuously and highly accurately controlling the drive voltage is necessary. Also, a drive voltage suitable for displaying a certain gray level changes depending on the temperature, and a greater voltage needs to be applied as the temperature lowers. Therefore, it is necessary to have a circuit that is capable of controlling the drive voltage continuously from a low voltage to a high voltage depending on the temperature.

SUMMARY

In accordance with some aspects of the invention, kinds of voltages to be applied to pixels are reduced, and gray levels corresponding to the characteristic of the device can be displayed.

An embodiment of the invention pertains to a control device for a display device that includes a plurality of first electrodes respectively provided for pixels, a second electrode disposed opposite the plurality of first electrodes, and an electro-optical material disposed between the plurality of first electrodes and the second electrode, the control device including an image acquisition part that designates a gray level value of each of the pixels, and acquires first image data with the number of gray levels being a-gray levels; a parameter acquisition part that acquires a parameter that decides the number of gray levels displayed by the pixel; a color reduction part that decides a number of gray levels to be displayed by the pixel according to the parameter acquired by the parameter acquisition part, and generates second image data in which the first image data acquired in the image acquisition part is color-reduced to the number of gray levels decided; and a write part that changes the gray level of the pixel to a gray level of the gray level value designated by the second image data generated in the color reduction part. In an aspect, the write part performs a first write operation of applying a first voltage to the first electrode of the pixel a plurality of times, when changing the gray level of the pixel in a direction from the second gray level to the first gray level, and performs a second write operation of applying a second voltage having a polarity different from the first voltage to the first electrode of the pixel a plurality of times, when changing the gray level of the pixel in a direction from the first gray level to the second gray level.

According to this configuration, the number of gray levels to be displayed at the pixel is decided according to the acquired parameter, which corresponds to the characteristic of the device, and the first image data that designates the gray level of the pixel is color-reduced to the number of gray levels decided, whereby the second image data is generated. Also, the first voltage or the second voltage is applied to the pixel multiple times such that the gray level of the pixel is changed to a gray level value designated by the second image data. As an image that has been color-reduced according to the characteristic of the device is displayed through application of the first voltage or the second voltage, the gray level corresponding to the characteristic of the device can be displayed with fewer kinds of voltages (e.g., two kinds of voltages in this example).

In the control device, the parameter acquisition part may acquire data indicative of the temperature as the parameter, and the color reduction part may decide the number of gray levels according to the data acquired by the parameter acquisition part, and may reduce the number of gray levels with an increase in the temperature. According to this configuration, when the gray level display characteristic of the pixel of the display device changes according to the temperature, the number of gray levels displayed by the pixel is decided in proportion to the temperature indicated by the parameter acquired, such that the gray level display corresponding to the characteristic of the device can be performed.

In the control device, the parameter acquisition part may acquire data indicative of the number of gray levels to be displayed by the pixel as the parameter, and the color reduction part may decide the number of gray levels to be displayed by the pixel to be the number of gray levels indicated by the data acquired by the parameter acquisition part. According to this configuration, the number of gray levels to be displayed by the pixel is decided to be the number of gray levels designated by the parameter, such that the gray level can be display according to the characteristic of the device.

In the control device, the color reduction part may have a dither matrix of arrayed threshold values. When color-reduction to two gray levels is performed, the color reduction part may generate the second image data with two gray levels according to a comparison result between the gray level values designated for each of the pixels by the first image data and the threshold values in the dither matrix respectively corresponding to the pixels. When color-reduction to n-gray levels of three or more gray levels is performed, the color reduction part may generate (n−1) threshold values for color-reduction to n-gray levels from the threshold values in the dither matrix corresponding to the respective pixels, and may generate the second image data with n-gray levels according to a comparison result between the (n−1) threshold values and the gray level values designated by the first image data. Because plural sets of threshold values can be generated from one dither matrix, the number of gray levels after color reduction can be changed according to the characteristic of the device.

Moreover, another embodiment of the invention pertains to a display device that includes a plurality of first electrodes respectively provided for pixels, a second electrode disposed opposite the plurality of first electrodes, and an electro-optical material disposed between the plurality of first electrodes and the second electrode. The display device includes an image acquisition part that designates a gray level value of each of the pixels, and acquires first image data with the number of gray levels being a-gray levels; a parameter acquisition part that acquires a parameter that decides the number of gray levels displayed by the pixel; a color reduction part that decides a number of gray levels to be displayed by the pixel according to the parameter acquired by the parameter acquisition part, and generates second image data in which the first image data acquired in the image acquisition part is color-reduced to the number of gray levels decided; and a write part that changes the gray level of the pixel to a gray level of the gray level value designated by the second image data generated in the color reduction part. In an aspect, the write part performs a first write operation of applying a first voltage to the first electrode of the pixel a plurality of times, when changing the gray level of the pixel in a direction from the second gray level to the first gray level, and performs a second write operation of applying a second voltage having a polarity different from the first voltage to the first electrode of the pixel a plurality of times, when changing the gray level of the pixel in a direction from the first gray level to the second gray level.

According to this configuration, the number of gray levels to be displayed by the pixel is decided according to the acquired parameter, which corresponds to the characteristic of the device, and the first image data that designates the gray level of the pixel is color-reduced to the number of gray levels decided, whereby the second image data is generated. Also, the first voltage or the second voltage is applied to the pixel multiple times such that the gray level of the pixel is changed to a gray level value designated by the second image data. As an image that has been color-reduced according to the characteristic of the device is displayed through application of the first voltage or the second voltage, the gray level corresponding to the characteristic of the device can be displayed with fewer kinds of voltages (e.g., two kinds of voltages in this example).

Note that the invention can be realized not only as the control device for a display device, and the display device, but also realized as a method for controlling the display device and an electronic apparatus having the display device.

PREFERRED EMBODIMENTS

Configuration of Embodiment

Figure 1:
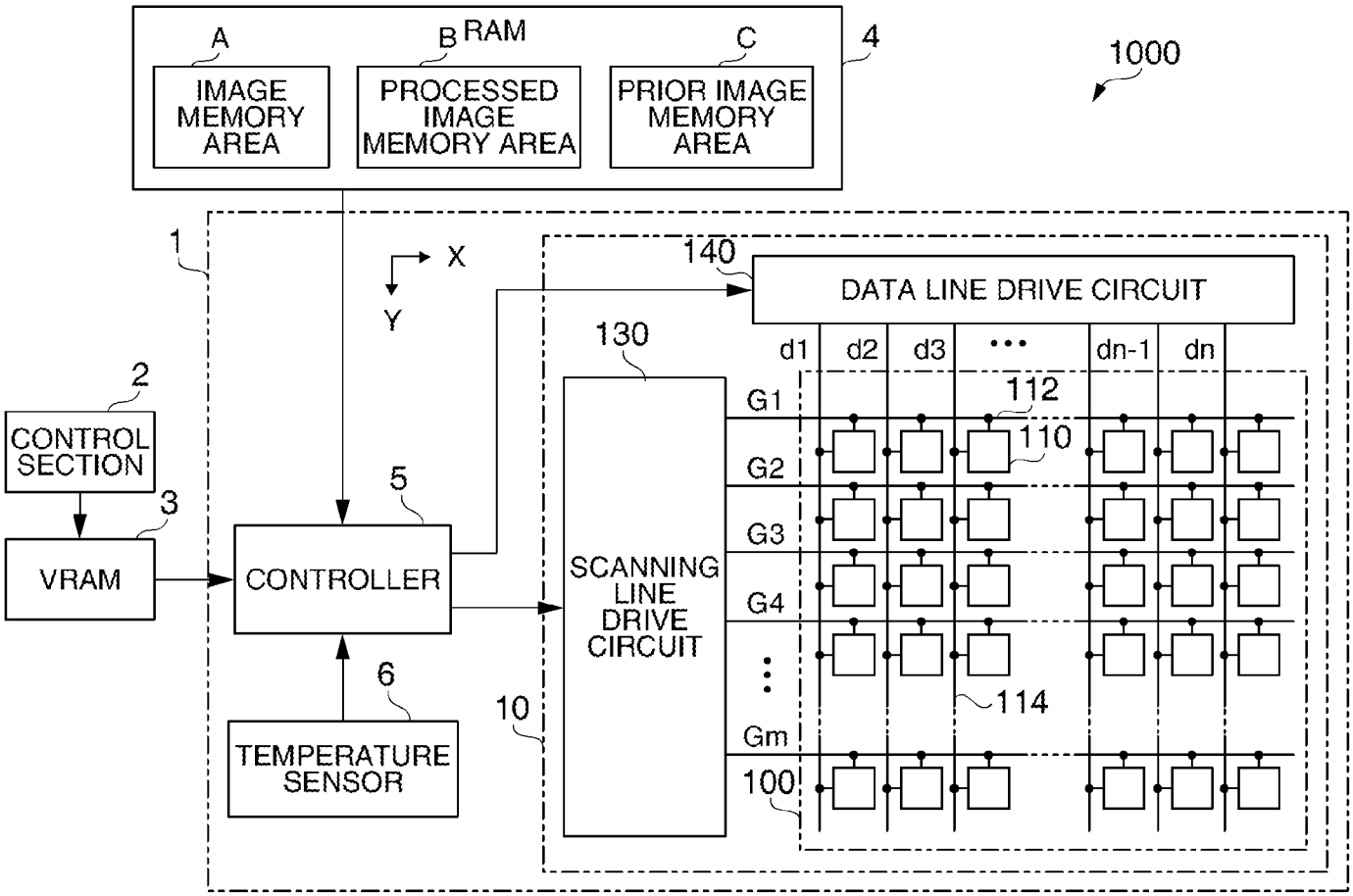
FIG. 1 is a diagram showing a hardware configuration of a display device 1000 and an electro-optic device 1 in accordance with a first embodiment of the invention.

FIG. 1 is a block diagram showing a hardware configuration of a display device 1000 in accordance with an embodiment of the invention. The display device 1000 is a device that displays an image, and is equipped with an electrophoretic electro-optic device 1, a control part 2, a VRAM (Video Random Access Memory) 3 and a RAM 4 that is an example of a storage part. Also, the electro-optic device 1 is equipped with a display part 10 and a controller 5.

The control part 2 is a microcomputer that is equipped with a CPU (Central Processing Unit), a ROM (Read Only Memory), a RAM, etc., and controls each of the parts of the display device 1000. Also, the control part 2 accesses the VRAM 3, and writes image data indicative of an image to be displayed in the display area 100 in the VRAM 3. The controller 5 supplies various signals, to a scanning line drive circuit 130 and a data line drive circuit 140 of the display part 10, for displaying the image in the display area 100 of the display part 10. The controller 5 corresponds to a control device of the electro-optic device 1. Note that the control part 2 and the controller 5 combined can be defined as a control device of the electro-optic device 1. Alternatively, the control part 2, the controller 5, the VRAM 3 and the RAM 4 as a whole can be defined as a control device of the electro-optic device 1.

The VRAM 3 is a memory that stores image data written by the control part 2. The VRAM 3 has a memory area (buffer) for each of the pixels 110 arranged by m rows×n columns to be described later. The image data contains data indicative of a gray level of each of the pixels 110, and data indicative of a gray level of one pixel 110 is stored in one memory area corresponding to the pixel 110 in the VRAM 3. The data written in the VRAM 3 is read out by the controller 5. In the embodiment, the image data takes one of the integers from 0 to 255, where 0 expresses black and 255 expresses white, and the gray level changes from black to white as the value becomes greater.

A temperature sensor 6 is provided for detecting the temperature. The temperature sensor 6 outputs a signal that expresses the detected temperature. Note that the temperature sensor 6 is disposed near the display area 100. The RAM 4 stores various data to be used for displaying an image in the display area 100. The RAM 4 has an image memory area A, a processed image memory area B, and a prior image memory area C. Each of the memory areas has a storage area corresponding to each of the pixels 110 of m rows×n columns, respectively. The image memory area A is an area where the image data read from the VRAM 3 is stored. The processed image memory area B is an area that stores processed image data of which the image data stored in the image memory area A has been processed. The prior image memory area C is an area that stores image data stored in the processed image storage area B, when the content of the VRAM 3 is detected as having been rewritten.

In the display area 100, a plurality of scanning lines 112 are provided along the row (X) direction in FIG. 1, and a plurality of data lines 114 are provided along the column (Y)

direction in a manner to be electrically insulated from the scanning lines 112. Further, the pixel 110 is provided corresponding to the intersection between each of the scanning lines 112 and each of the data lines 114. Assuming for the sake of convenience that the number of rows of the scanning lines 112 is "m" and the number of columns of the data lines 114 is "n", the pixels 110 are arrayed in a matrix (m rows×n columns) to form the display area 100.

Figure 2:
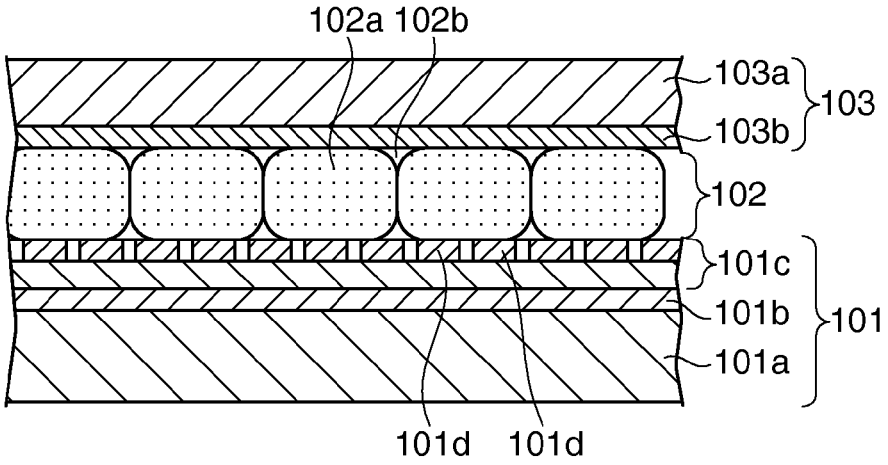
FIG. 2 is a view showing a cross section of a display area 100.

FIG. 2 is a view showing the cross section of the display area 100. As shown in FIG. 2, the display area 100 is formed generally from a first substrate 101, an electrophoretic layer 102, and a second substrate 103. The first substrate 101 is a substrate in which a circuit layer is formed on an insulating and flexible substrate 101*a*. In the present embodiment, the substrate 101*a* is formed from polycarbonate. Note that a resin material which is light and flexible, and has elasticity and insulation property may also be used for the substrate 101*a* without any particular limitation to polycarbonate. Also, the substrate 101*a* may be formed from glass which does not have flexibility. An adhesive layer 101*b* is provided on the surface of the substrate 101*a*, and a circuit layer 101*c* is laminated on the surface of the adhesive layer 101*b*. The circuit layer 101*c* has a plurality of scanning lines 112 arrayed in the row direction and a plurality of data lines 114 arrayed in the column direction. Also, the circuit layer 101*c* has a pixel electrode 101*d* (a first electrode) corresponding to each of the intersections between the scanning lines 112 and the data lines 114.

The electrophoretic layer 102, that is an example of an electro-optic material, is formed from a binder 102*b* and a plurality of microcapsules 102*a* fixed by the binder 102*b*, and is formed on the pixel electrodes 101*d*. It is noted that an adhesive layer formed from an adhesive may be provided between the microcapsules 102*a* and the pixel electrodes 101*d*.

The binder 102*b* may be made of any material that has good affinity with the microcapsules 102*a*, excellent adhesion to the electrodes, and dielectric property, without any particular limitation. Each of the microcapsules 102*a* contains a dispersion medium and electrophoretic particles. The microcapsules 121 may preferably be made of a material having flexibility, such as, composites of gum arabic and gelatin, urethane compounds, and the like.

As the dispersion medium, it is possible to use any one of materials including water; alcohol solvents (such as, methanol, ethanol, isopropanol, butanol, octanol, and methyl cellosolve); esters (such as, ethyl acetate and butyl acetate); ketones (such as, acetone, methyl ethyl ketone, and methyl isobutyl ketone); aliphatic hydrocarbons (such as, pentane, hexane, and octane); alicyclic hydrocarbons (such as, cyclohexane and methylcyclohexane); aromatic hydrocarbons (such as, benzene, toluene, long-chain alkyl group-containing benzenes (such as, xylenes, hexylbenzene, heptylbenzene, octylbenzene, nonylbenzene, decylbenzene, undecylbenzene, dodecylbenzene, tridecylbenzene, and tetradecylbenzene)); halogenated hydrocarbons (such as, methylene chloride, chloroform, carbon tetrachloride, and 1,2-dichloroethane); and carboxylates. Also, the dispersion medium may be made of any one of other various oils. As the dispersion medium, one or any of the materials described above in combination may be used. Further in another example, the dispersion medium may be further mixed with a surfactant.

The electrophoretic particles are particles (polymer or colloid) having a property in which the particles move in the dispersion medium by electric fields. In the present embodiment, white electrophoretic particles and black electrophoretic particles are contained in each of the microcapsules 102*a*. The black electrophoretic particles are particles formed of black pigments, such as, aniline black, carbon black and the like, and are positively charged in the present embodiment. The white electrophoretic particles are particles formed of white pigment, such as, titanium dioxide, aluminum oxide and the like, and are negatively charged in the present embodiment.

The second substrate 103 includes a film 103*a* and a transparent common electrode layer 103*b* (second electrode) formed on the bottom surface of the film 103*a*. The film 103*a* serves to seal and protect the electrophoretic layer 102, and is a polyethylene terephthalate film, for example. The film 103*a* is transparent and has an insulation property. The common electrode layer 103*b* is formed from a transparent conductive film, such as, an indium tin oxide film (ITO film).

Figure 3:
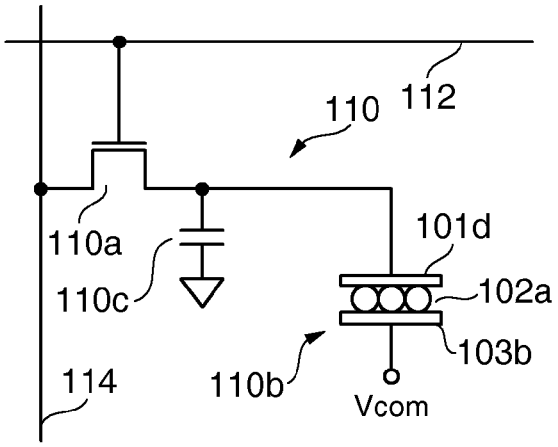
FIG. 3 is a view showing an equivalent circuit of a pixel 110.

FIG. 3 is a view showing an equivalent circuit of the pixel 110. In the present embodiment, in order to distinguish the scanning lines 112, the scanning lines 112 shown in FIG. 1 may be called scanning lines on the first, the second, the third, . . . , the $(m-1)^{-th}$, and the $m^{-th}$ rows in this order from the top. Similarly, in order to distinguish the data lines 114, the data lines 114 shown in FIG. 1 may be called data lines on the first, the second, the third, . . . , the $(n-1)^{-th}$, and the $n^{-th}$ columns in this order from the left.

FIG. 3 shows an equivalent circuit of the pixel 110 corresponding to the intersection between the scanning line 112 on the $i^{-th}$ row and the data line 114 on the $j^{-th}$ column. Since the pixels 110 corresponding to the intersections between other data lines 114 and other scanning lines 112 also have the same configuration shown in the drawing, an equivalent circuit of the pixel 110 corresponding to the intersection between the data line 114 on the $i^{-th}$ row and the scanning line 112 on the $j^{-th}$ column will be described as representative, and explanation regarding equivalent circuits of the other pixels 110 will be omitted.

As shown in FIG. 3, each of the pixels 110 has an n channel type thin film transistor (hereinafter, abbreviated as a "TFT") 110*a*, a display element 110*b*, and an auxiliary capacitor 110*c*. In the pixel 110, the TFT 110*a* has a gate electrode connected to the scanning line 112 on the $i^{-th}$ row, a source electrode connected to the data line 114 on the $j^{-th}$ column, and a drain electrode connected to a pixel electrode 101*d*, which is an end of the display element 110*b*, and an end of the auxiliary capacitor 110*c*. The auxiliary capacitor 110*c* has a configuration in which a dielectric layer is interposed between a pair of electrodes formed in the circuit layer 101*c*. The other electrode of the auxiliary capacitor 110*c* is given a voltage common to all pixels. The pixel electrode 101*d* faces the common electrode layer 103*b*, and the electrophoretic layer 102 is interposed between the pixel electrode 101*d* and the common electrode layer 103*b*. Therefore, when seen in the equivalent circuit, the display element 110*b* defines a capacitor in which the electrophoretic layer 102 is interposed between the pixel electrode 101*d* and the common electrode layer 103*b*. In addition, the display element 110*b* retains (stores) a voltage between these electrodes and performs display according to the direction of an electric field caused by the retained voltage. Moreover, in the present embodiment, a common voltage Vcom is applied to the other end of the auxiliary capacitor 110*c* of each pixel 110 and the common electrode layer 103*b* by an external circuit (not shown).

Referring back to FIG. 1, the scanning line driving circuit 130 is connected to each of the scanning lines 112 of the display area 100. Under the control of the controller 5, the scanning line drive circuit 130 sequentially selects the scanning lines 112 at the first, the second, . . . , and the $m^{-th}$ rows in this order, and supplies a high-level (High) signal to the selected scanning line 112 and supplies a low-level (Low) signal to the other scanning lines 112 which are not selected. The data line drive circuit 140 is connected to each of the data lines 114 in the display area, and supplies a data signal to the data line 114 on each of the columns according to the display content of the pixels 110 for one row which are connected to the selected scanning line 112.

During a period starting from the selection of the scanning line 112 in the $1^{st}$ row by the scanning line drive circuit 130 until the completion of the selection of the scanning line in the $m^{-th}$ row (hereafter referred to as a "frame period" or, simply a "frame"), each of the scanning lines 112 is selected once, and a data signal is supplied to each of the pixels 14 once in each frame.

When the scanning line 112 assumes the high level, the TFT 110*a* whose gate is connected to the scanning line 112 is set to an ON state, whereby the pixel electrode 101*d* is connected to the data line 114. If a data signal is supplied to the data line 114 when the scanning line 112 is at a high level and, the data signal is applied to the pixel electrode 101*d* through the TFT 110*a* which is in the ON state. When the scanning line 112 assumes the low level, the TFT 110*a* is set to an OFF state. However, the voltage applied to the pixel electrode 101*d* by the data signal is accumulated in the auxiliary capacitor 110*c*, and electrophoretic particles move according to the potential difference (voltage) between the electric potential of the pixel electrode 101*d* and the electric potential of the common electrode layer 103*b*.

For example, when the voltage on the pixel electrode 101*d* is +15V (second voltage) with respect to the voltage Vcom on the common electrode layer 103*b*, white electrophoretic particles negatively charged move toward the pixel electrode 101*d* and black electrophoretic particles positively charged move toward the common electrode layer 103*b*. As a result, the pixel 110 is displayed in black. On the other hand, when the voltage on the pixel electrode 101*d* is −15V (first voltage) with respect to the voltage Vcom on the common electrode layer 103*b*, black electrophoretic particles positively charged move toward the pixel electrode 101*d* and white electrophoretic particles negatively charged move toward the common electrode layer 103*b*. As a result, the pixel 110 is displayed in white. Note that the voltage on the pixel electrode 101*d* is not limited to the above-described voltage, and may be a voltage other than +15V or −15V as long as it is a positive or negative voltage with respect to the voltage Vcom of the common electrode layer 103*b*.

In the present embodiment, when changing the display state of each pixel 110 from white (low gray level) as the first gray level to black (high gray level) as the second gray level or from black to white, the display state is changed by a write operation in which data signals are supplied to the pixel 110 over a plurality of frames, instead of changing the display state by supplying a data signal to the pixel 110 in only one frame. This is because, when changing the display state from white to black, black electrophoretic particles do not move to the display side completely even if the potential difference is given to the electrophoretic particles in only one frame, and therefore the display state does not become a fully black display state. This is the same for white electrophoretic particles when changing the display state from black to white. Therefore, for example, when changing the display state of the pixel 110 from white to black, data signals for displaying the black on the pixel 110 are supplied to the pixel 110 over a plurality of frames, and when changing the display state of the pixel 110 from black to white, data signals for displaying the white on the pixel 110 are supplied to the pixel 110 over a plurality of frame. Note that, in the present embodiment, the "write operation" refers to a data signal supply sequence of supplying data signals to pixels for changing the display state of the pixels to a display state of a desired gray level, or a sequence of applying voltages between the common electrode layer 103*b* and the pixel electrode 101*d*, which is performed based on the data signal supply sequence.

Moreover, in the present embodiment, the pixel electrode 101*d* of a certain pixel 110 in one frame may be set as a positive electrode with a higher electric potential than the common electrode layer 103*b*, and the pixel electrode 101*d* of another pixel 110 in the same frame maybe set as a negative electrode with a lower electric potential than the common electrode layer 103*b*. On other words, a driving operation that is capable of selecting both electrodes of positive and negative electrodes with respect to the common electrode layer 103*b* in one frame (hereinafter, referred to as bipolar driving) is performed. More specifically, in one frame, the pixel electrode 101*d* of the pixel 110 whose gray level is changed to the high gray level side (second gray level side) is set as a positive electrode, and the pixel electrode 101*d* of the pixel 110 whose gray level is changed to the low gray level side (first gray level side) is set as a negative electrode. Note that, when black electrophoretic particles are negatively charged and white electrophoretic particles are positively charged, the pixel electrode 101*d* of the pixel 110 whose gray level is changed to the high gray level side (second gray level side) may be set as a negative electrode, and the pixel electrode 101*d* of the pixel 110 whose gray level is changed to the low gray level side (first gray level side) may be set as a positive electrode.

Figure 4:
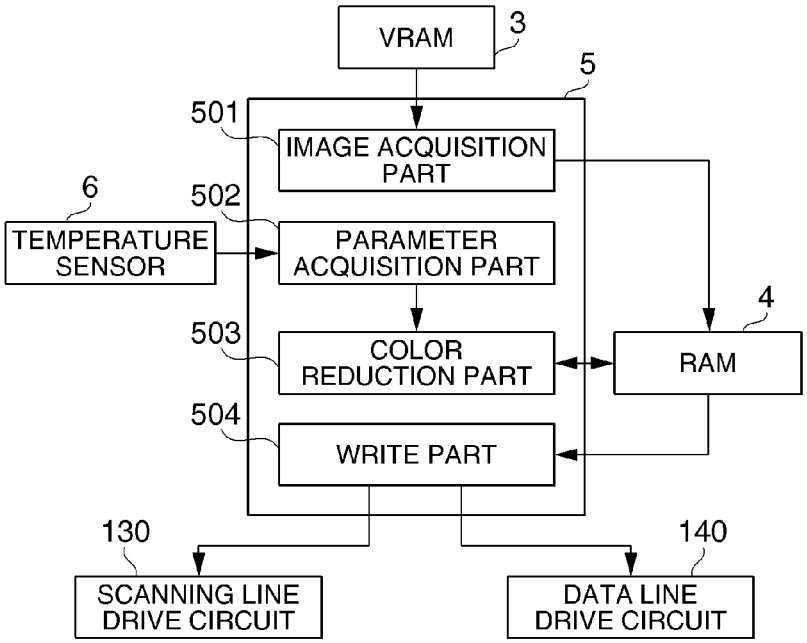
FIG. 4 is a block diagram showing a configuration of functions realized by a controller 5.

Next, the configuration of the controller 5 will be described. FIG. 4 is a block diagram showing functions realized in the controller 5 in accordance with the present embodiment. In the controller 5, an image acquisition part 501, a parameter acquisition part 502, a color reduction part 503, and a write part 502 are realized. Note that the blocks may be realized by hardware, or may be realized by a program to be executed by a CPU provided in the controller 5.

The image acquisition part 501 is a block that acquires image data (first image data) stored in the VRAM 3, and stores the acquired image data in the image memory area A of the RAM 4. Moreover, after storing the image data memorized in the VRAM 3 in the image memory area A of the RAM 4, the image acquisition part 501 stores the image data stored in the processed image memory area B in the prior image memory area C.

The parameter acquisition part 502 is a block that acquires a parameter for deciding the number of gray levels to be displayed by the pixel 110. In the embodiment, the signal output from the temperature sensor 6 is acquired as a parameter.

The color reduction part 503 is a block that renders a color reduction processing on the image data stored in the image memory area A. The color reduction part 503 specifies the temperature that is detected by the temperature sensor 6 based on the signal that is acquired by the parameter acquisition part 502. Also, the color reduction part 503 decides a number of gray levels that is to be displayed by the pixel 110 according to the specified temperature, and renders the color reduction processing on the image data such that it assumes the decided number of gray levels. The image data rendered with the color reduction processing is stored in the processed image memory area B.

In the embodiment, when the temperature specified by the parameter acquisition part 502 is 30° C. or higher, the color reduction part 503 sets the gray levels that can be expressed by the image data to be two gray levels (black and white). When the temperature specified by the parameter acquisition part 502 is lower than 30° C., the color reduction part 503 sets the gray levels that can be expressed by the image data to be four gray levels (black, dark gray, light gray and white). In the image data after the color reduction processing has been rendered, the value that expresses the gray level of the pixel assumes to be one of 0 through 3, and the smaller the gray level value, the higher density the gray level becomes, where 0 expresses black, 1 expresses the dark gray, 2 expresses the light gray, and 3 expresses white.

The write part 504 controls the scanning line drive circuit 130 and the data line drive circuit 140, and applies the first voltage or the second voltage to the pixel electrode 101*d* of each of the pixels 110 based on the image data stored in the processed image memory area B and the prior image memory area C. The controller 5 stores a table shown in FIG. 5. The table shown in FIG. 5 stores the number of times of voltage application to the pixel 110 when the gray level of the pixel 110 is to be changed as a result of the content of the VRAM 3 having been rewritten.

The controller 5 acquires the gray level value before change from the prior image memory area C, and acquires the gray level value after change from the processed image memory area B. According to FIG. 5, when the gray level value before change, for example, is 0 (black), and the gray level value after change is 3 (white), when the voltage of −15V with respect to the voltage Vcom of the common electrode layer 10 is applied to the pixel electrode 101*d* six times, the pixel changes from the black state to the white state. When the gray level value before change is 0 (black), and the gray level value after change is 2 (light gray), when the voltage of −15V with respect to the voltage Vcom is applied to the pixel electrode 101*d* four times, the gray level value becomes to be 2. When the gray level value before change is 0 (black), and the gray level value after change is 1 (dark gray), when the voltage of −15V with respect to the voltage Vcom is applied to the pixel electrode 101*d* two times, the gray level value becomes to be 1. Also, when the gray level value before change is 3 (white), and the gray level value after change is 0 (black), when the voltage of +15V with respect to the voltage Vcom is applied to the pixel electrode 101*d* six times, the pixel changes from the white state to the black state.

Figure 5:
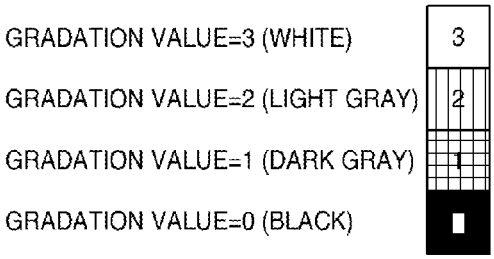
FIG. 5 is an illustration showing numbers of times of voltage application required for changing gray levels.

By applying the voltage to the pixel electrode 101*d* according to the table shown in FIG. 5, the gray level of the pixel can be changed. However, at higher temperatures, the viscosity of the dispersion medium becomes lower, and the electrophoretic particles would move more easily. Accordingly, even if the voltage is applied the same number of times, the dark gray and the light gray could vary in gray level. Therefore, in accordance with the embodiment, in the state where the temperature is high and fine control of the gray level is therefore difficult, the number of gray levels to be displayed is reduced. Meanwhile, in the state where the temperature is low and fine control of the gray level is thus relatively easy, the number of gray levels to be displayed is increased, thereby suppressing variations in the displayed gray level. The operation will be described in greater detail.

Figures 6, 7:
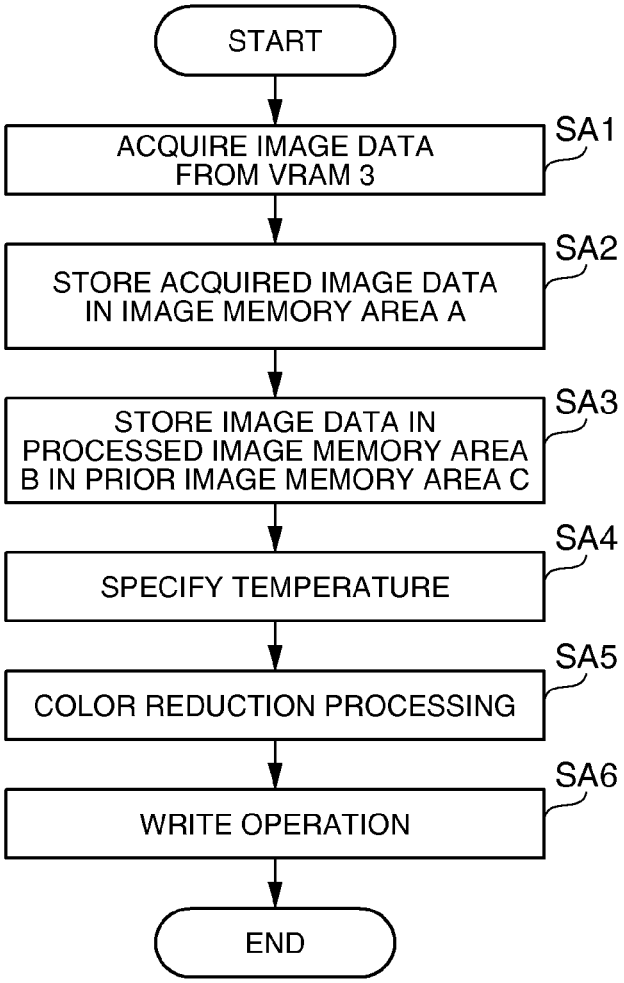
FIG. 6 is a flow chart showing a flow of processings executed by the controller 5.
FIG. 7 is an illustration showing an example of a first dither matrix.

FIG. 6 is a flow chart showing the flow of processings executed by the controller 5. The controller 5 observes writing of image data to the VRAM 3. The controller 5 (e.g., the image acquisition part 501) acquires image data stored in the VRAM 3 when there is a change in the content of the VRAM 3 (step SA1 (image acquisition step)), and has the acquired image data stored in the image memory area A (step SA2). Here, the gray level values of the pixels are stored in a matrix corresponding respectively to the pixels 110 of m rows×n columns. Moreover, the controller 5 has the image data that is stored in the processed image memory area B stored in the prior image memory area C (step SA3). By step SA3, the image data of the image displayed at this point will be stored in the prior image memory area C.

Next, the controller 5 (e.g., the parameter acquisition part 502) acquires a signal output from the temperature sensor 6 (parameter acquisition step). Then, the controller 5 (e.g., the color reduction part 503) specifies the temperature detected with the temperature sensor 6 based on the acquired signal (step SA4). The controller 5 (e.g., the color reduction part 503), that specified the temperature, renders the color reduction processing corresponding to the specified temperature on the image data stored in the image memory area A (step SA5 (color reduction step)).

An example of the color reduction processing in accordance with the present embodiment will be described below. The controller 5 stores a first dither matrix of four rows by four columns (see FIG. 7), and the first dither matrix stores threshold values to binarize the image data stored in the image memory area A. The threshold value is any one of values from 0 to 255.

When the temperature specified in step SA4 is 30° C. or higher, the controller 5 superposes the first dither matrix over the image data arrayed in a matrix that is stored in the image memory area A. The controller 5 adds the gray level value of each of the pixels stored in the image memory area A respectively to each of the values of the first dither matrix superposed on these gray level values. When the addition result becomes less than 256, the controller 5 changes the gray level value of those of the pixels whose addition result is less than 256 to 0 (black), and changes the gray level value of those of the pixels whose addition result becomes 256 or more to 3 (white). The controller 5 has the gray level values after the change stored in the processed image memory area B. As a result, the image data stored in the processed image memory area B becomes an image in two gray levels of black and white.

On the other hand, when the temperature specified in step SA3 is less than 30° C., the controller 5 creates a second dither matrix in which each of the values in the first dither matrix is divided by three. Next, the controller 5 superposes the second dither matrix over the image data arrayed in a matrix in the image memory area A. The controller 5 adds the gray level value of each of the pixels stored in the image memory area A and each of the values of the second dither matrix superposed respectively on these gray level values plus 170. When the addition result becomes less than 256, the controller 5 changes the gray level value of those of the pixels whose addition result is less than 256 to 0 (black), and has the gray level values after the change stored in the processed image memory area B.

On the other hand, when the addition result becomes 256 or more, the controller 5 adds the gray level value of each of such pixels stored in the image memory area A and each of the values of the second dither matrix superposed respectively on these gray level values plus 65. When the addition result becomes less than 256, the controller 5 changes the gray level value of those of pixels to 1 (dark gray), and has the gray level value after the change stored in the processed image memory area B.

On the other hand, when the addition result of the gray level value of the pixel and the value of the second dither matrix plus 65 is 256 or more, the controller 5 adds the gray level value of each of such pixels stored in the image memory area A to each of the values of the second dither matrix superposed respectively on the gray level values. When the addition result becomes less than 256, the controller 5 changes the gray level value of each of those of the pixels to 2 (light gray). When the addition result becomes 256 or more, the controller 5 changes the gray level value of each of those of the pixels to 3 (white). Then the gray level values after the change are stored in the processed image memory area B. As a result, the image data stored in the processed image memory area B becomes an image in four gray levels of black, dark gray, light gray and white.

When the color reduction processing is finished, the controller 5 (the writing part 504) executes a writing operation (step SA6 (writing step)), using the image data stored in the processed image memory area B, and the image data stored in the prior image storage area C. More specifically, the controller 5 acquires, for each of the pixels, the gray level value stored in the processed image memory area B and the gray level value stored in the prior image memory area C. The controller 5 assumes the gray level value acquired from the processed image memory area B as a gray level value after change, and the gray level value acquired from the prior image memory area C as a gray level value before change, and decides the number of times of voltage application for each of the pixels by referring to the table of FIG. 5. Having decided the number of times of voltage application, the controller 5 specifies, based on the gray level value stored in the processed image memory area B and the gray level value stored in the prior image memory area C, as to whether the gray level of the pixel should be changed toward white or changed toward black. When the gray level is to be changed toward white, the controller 5 applies the voltage of −15V with respect to the voltage Vcom to the pixel electrode 101*d* by the decided number of times of voltage application. When the gray level is to be changed toward black, the controller 5 applies the voltage of +15V with respect to the voltage Vcom to the pixel electrode 101*d* by the decided number of times of voltage application.

According to the embodiment, the voltage to be applied to the pixel electrode is +15V, −15V or 0V with respect to the voltage Vcom. Even if the voltage to be applied to the pixel is not continuously controlled, the gray level of the pixel can be changed by controlling the number of times of application of these voltages. Moreover, in the state where the temperature is high and the electrophoretic particles would easily move, the number of gray levels to be displayed is suppressed. Accordingly, the pixels to be displayed have few variations in the gray level even when the temperature condition changes, whereby the gray level display corresponding to the situation can be performed.

Electronic Apparatus

Figure 8:
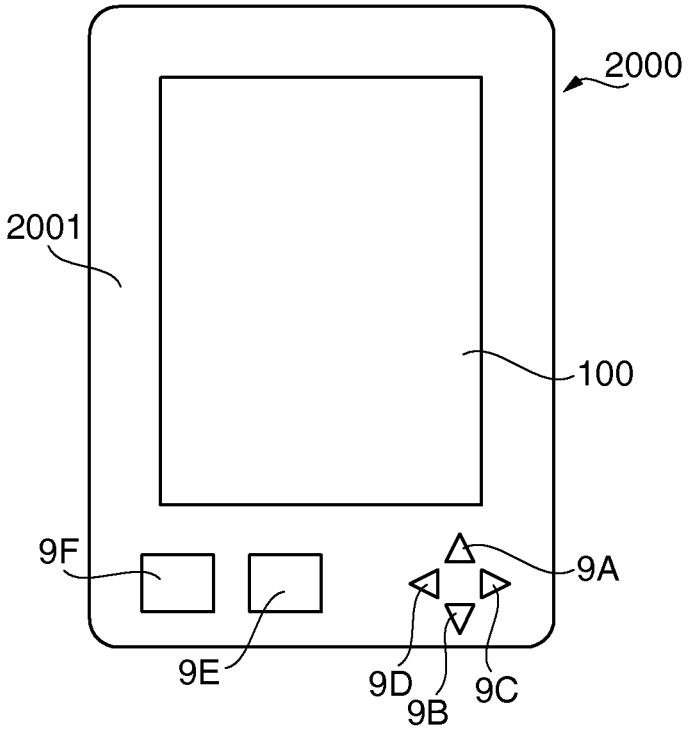
FIG. 8 is an appearance of an electronic book reader 2000.

Next, an example of an electronic apparatus to which the display device 1000 according to the embodiment is applied will be described. FIG. 8 is a view showing the appearance of an electronic book reader using the display device 1000 in accordance with the embodiment described above. An electronic book reader 2000 includes a plate shaped frame 2001, buttons 9A to 9F, the electro-optical device 1 according to the embodiment described above, the control unit 2, the VRAM 3, and the RAM 4. In the electronic book reader 2000, the display area 100 is exposed. In the electronic book reader 2000, the content of electronic book is displayed in the display area 100, and the pages of the electronic book are turned over by operating the buttons 9A to 9F. In addition, examples of an electronic apparatus to which the electro-optical device 1 according to the embodiment described above can be applied may include a timepiece, electronic paper, an electronic diary, a calculator, a mobile phone, and the like.

While the embodiments of the invention have been described above, the invention is not limited to the embodiments described above and various modifications may also be made. For example, the invention may also be implemented by modifying the above-described embodiments as follows. In addition, the above-described embodiments and the following modification examples may be combined.

In the embodiment described above, the electro-optical device including the electrophoretic layer 102 has been described as an example. However, the invention is not at all limited to such example. The invention is applicable to any electro-optical devices as long as the writing for changing the display state of a pixel from the first display state to the second display state is performed by a writing operation in which voltage is applied multiple times. For example, it is also possible to use an electro-optical device using electronic liquid powder.

In the embodiment described above, the number of gray levels after the color reduction processing is two gray levels or four gray levels. However, the invention is not limited to these numbers of gray levels. For example, the number of gray levels may be 16 gray levels when the temperature specified by the temperature sensor 6 is less than 20° C., 8 gray levels at 20° C. and above but less than 25° C., 4 gray levels at 25° C. and above but less than 30° C., 3 gray levels at 30° C. and above but less than 35° C., and 2 gray levels at 35° C. and above.

In the embodiment described above, the number of gray levels to be displayed by pixels is changed based on the temperature. However, the number of gray levels to be displayed by pixels may be changed according to parameters other than the temperature. For example, the user may operate the buttons 9A-9F on the electronic book reader 2000 to designate the number of gray levels to be displayed by the pixels, and the controller 5 (the parameter acquisition part 502) may acquire data (a parameter) that expresses the number of gray levels specified by the user, and may perform the color reduction processing such that the number of gray levels is expressed according to the acquired data.

Moreover, by adjusting the dispersion medium and the electrophoretic particles that compose the micro capsules 102*a*, the number of gray levels suitable for the display can be adjusted, whereby an electro-optic device 1 having pixels suitable for the display in two gray levels and an electro-optic device 1 having pixels suitable for the display in three or more gray levels can be composed. In this case, the controller 5 (the parameter acquisition part 502) may acquire, for example, from the control part 2, data (a parameter) indicative of whether the pixels are suitable for displaying one of the numbers of gray levels or the other, and may perform the color reduction processing to the image data stored in the image memory area A such that the number of gray levels according to the acquired data is displayed.

In the embodiment described above, the first dither matrix is stored, and threshold values to be used for performing the color reduction processing are generated from the first dither matrix. However, threshold values from 0 to 255 may be set for each of the gray levels after the color reduction and a dither matrix may be provided for each of the gray levels. Further, although a dither matrix is used for the color reduction processing in the embodiment described above, the color reduction processing may be performed by any one of other known color reduction processings (such as, for example, an error diffusion method) besides the method of the embodiment.

The embodiment described above is composed such that an image is displayed by using a dispersion medium and electrophoretic particles. However, an electro-optic device that uses a liquid crystal as the electro-optic material may have a composition in which the number of gray levels to be displayed is changed according to the temperature. When the liquid crystal is used, the transmissivity decreases at low temperatures more than at high temperatures. Therefore, the color reduction processing may be performed such that the number of gray levels to be displayed is reduced at low temperatures, and the number of gray levels to be displayed is increased at high temperatures.

The entire disclosure of Japanese Patent Application No. 2012-067171, filed Mar. 23, 2012 is expressly incorporated by reference herein.

What is claimed is:

1. A control device for an electrophoretic display device that includes a plurality of first electrodes respectively provided for pixels, a second electrode disposed opposite the plurality of first electrodes, and an electro-optical material comprising electrophoretic particles in a dispersion medium disposed between the plurality of first electrodes and the second electrode, the control device comprising:

an image acquisition part that designates an image by assigning a gray level value of each of the pixels, and acquires first image data which is represented by four different gray levels;

a parameter acquisition part that receives a detected temperature from a temperature sensor;

a color reduction part that sets a number of gray levels with which the image is to be displayed by the pixel according to the detected temperature received by the parameter acquisition part, such that when the detected temperature is greater than a predetermined threshold the color reduction part generates second image data in which the image is represented by two different gray levels; and a write part that changes the gray level of the pixel to one of the two different gray levels designated by the second image data, wherein the control device displays the image using the four gray levels by applying an electric field to the electrophoretic particles when the detected temperature is equal to or less than the predetermined threshold and displays the image using the two gray levels by applying the electric field to the electrophoretic particles when the detected temperature is greater than the predetermined threshold.

2. The control device for a display device according to claim 1, wherein the color reduction part reduces the number of gray levels from four to two with an increase in the temperature.

3. The control device for a display device according to claim 1, wherein the parameter acquisition part acquires data indicative of the number of gray levels to be displayed by the pixel, and the color reduction part decides the number of gray levels to be displayed by the pixel to be the gray level number indicated by the data acquired by the parameter acquisition part.

4. The control device for a display device according to claim 1, wherein the color reduction part has a dither matrix of arrayed threshold values;

for color-reduction to two gray levels, the color reduction part generates the second image data with two gray levels according to a comparison result between the gray level values designated for each of the pixels by the first image data and the threshold values in the dither matrix respectively corresponding to the pixels.

5. The control device for a display device according to claim 1, wherein the write part performs a first write operation of applying a first voltage to the first electrode of the pixel a plurality of times, when changing the gray level of the pixel in a direction from a second gray level to a first gray level, and performs a second write operation of applying a second voltage having a polarity different from the first voltage to the first electrode of the pixel a plurality of times, when changing the gray level of the pixel in a direction from the first gray level to the second gray level.

6. A method for controlling an electrophoretic display device that includes a plurality of first electrodes respectively provided for pixels, a second electrode disposed opposite the plurality of first electrodes, and an electro-optical material comprising electrophoretic particles in a dispersion medium disposed between the plurality of first electrodes and the second electrode, the method comprising:

designating an image by assigning a gray level value of each of the pixels, and acquiring first image data which is represented by four different gray levels;

receiving a detected temperature from a temperature sensor;

setting a number of gray levels with which the image is to be displayed by the pixel according to the detected temperature received by the parameter acquisition part, such that when the detected temperature is equal to or less than a predetermined threshold, the number of gray levels is set to four different gray levels and when the detected temperature is greater than the predetermined threshold, the number of gray levels is set to two different gray levels;

generating second image data which is represented by the two different gray levels from the first image data; and changing the gray level of the pixel to a gray level of the two different gray levels designated by the second image data.

7. An electrophoretic display device including a plurality of first electrodes respectively provided for pixels, a second electrode disposed opposite the plurality of first electrodes, and an electro-optical material comprising electrophoretic particles in a dispersion medium disposed between the plurality of first electrodes and the second electrode, the display device comprising:

an image acquisition part that designates an image by assigning a gray level value of each of the pixels, and acquires first image data which is represented by four different gray levels;

a parameter acquisition part that receives a detected temperature from a temperature sensor;

a color reduction part that sets a number of gray levels with which the image is to be displayed by the pixel according to the detected temperature received by the parameter acquisition part, such that when the detected temperature is greater than a predetermined threshold the color reduction part generates second image data in which the image is represented by two different gray levels; and a write part that changes the gray level of the pixel to one of the two different gray levels designated by the second image data, wherein the control device displays the image using the four gray levels by applying an electric field to the electrophoretic particles when the detected temperature is equal to or less than the predetermined threshold and displays the image using the two gray levels by applying the electric field to the electrophoretic particles when the detected temperature is greater than the predetermined threshold.

8. An electronic apparatus comprising the display device recited in claim 7.

* * * * *